US006944509B2

(12) United States Patent
Altmaier et al.

(10) Patent No.: US 6,944,509 B2
(45) Date of Patent: Sep. 13, 2005

(54) APPARATUS AND METHOD FOR SCOREBOARD CONTROL WITH DYNAMIC VISUAL INDICATORS

(76) Inventors: Elizabeth Altmaier, 22605 Salem Ave., Cupertino, CA (US) 95014; Rachel Altmaier, 22605 Salem Ave., Cupertino, CA (US) 95014

( * ) Notice: Subject to any disclaimer, the term of this patent is extended or adjusted under 35 U.S.C. 154(b) by 350 days.

(21) Appl. No.: 10/278,583

(22) Filed: Oct. 23, 2002

(65) Prior Publication Data

US 2004/0080485 A1 Apr. 29, 2004

(51) Int. Cl.[7] ..... G06F 3/00

(52) U.S. Cl. ..... 700/92; 700/90; 700/91; 345/156

(58) Field of Search ..... 700/90, 91, 92; 345/156; 473/70

(56) References Cited

U.S. PATENT DOCUMENTS 3,981,002 A * 9/1976 Gardner ..... 345/2.1
4,013,292 A * 3/1977 Cohen et al. ..... 273/371
5,027,102 A * 6/1991 Sweeny ..... 340/323 R
5,198,976 A * 3/1993 Form et al. ..... 700/91
5,241,379 A * 8/1993 Tsujita ..... 348/157
5,341,121 A * 8/1994 Rada ..... 340/323 R
5,898,587 A * 4/1999 Bell et al. ..... 700/92
6,148,242 A * 11/2000 Descalzi et al. ..... 700/90
6,725,107 B2 * 4/2004 MacPherson ..... 700/92

* cited by examiner

*Primary Examiner*—Sumati Lefkowitz
*Assistant Examiner*—Ming-Hun Liu
(74) *Attorney, Agent, or Firm*—Edward C. Kwok; MacPherson Kwok Chen & Heid LLP

(57) ABSTRACT

An apparatus and an associated method ensure accurate scoring at a sporting event by associating controls of a score board with the colors worn by the teams, or the positions of the goals (e.g., goals in a basketball tournament). In one implementation, the apparatus alerts a scorekeeper when a play condition reaches a threshold.

30 Claims, 4 Drawing Sheets

APPARATUS AND METHOD FOR SCOREBOARD CONTROL WITH DYNAMIC VISUAL INDICATORS

BACKGROUND OF THE INVENTION

1. Field of the Invention

The present invention relates to the scoring in sports events. In particular, the present invention relates to devices and methods ensuring accurate scoring of a game between opposing teams in tournament play.

2. Discussion of the Related Art

As volunteer scorekeepers in sport tournaments, and as spectators in such events, the inventors of the present invention observe that scorekeeping using existing score board control devices is error prone. Sometimes, errors crediting points scored to the wrong team are made. For example, in team sports such as basketball, the opposing teams are typically identified on the scoreboard and its controls as "Home" and "Guest." Thus, the controls of such a score board require the scorekeeper to correctly identify the home or guest designation of a team to correctly credit the score to that team. In the past, to help the scorekeepers, it was customary for the home team to wear light color uniforms, while the guest team wears dark color uniforms. Unfortunately, this convention is no longer strictly observed. Today, the teams are more likely to appear in different color uniforms. As a result, in the excitement of a tournament, scorekeepers are often confused momentarily as to the "home" and "guest" designation of the teams when they operate the controls of a scoreboard, resulting in points being credited to the wrong team.

Errors also often arise immediately after half-time in some sports, such as basketball. In basketball, each team is assigned one of the two baskets located at opposite ends of the court as its "own". Baskets that are made at that basket, whether by the owning team (in the normal course), or inadvertently by the opposing team, are credited to the owning team. Ownership of the baskets is swapped at half-time. Errors often arise after half-time, as scorekeepers are sometimes confused immediately after the ownership swap.

Errors often arise also because of complex scoring rules. In basketball, for example, if one team commits seven (7) fouls in one half, the opposing team moves into "bonus" play. If the team fouls reach ten (10) in that half, the opposing team moves into "double bonus" play. Foul counts are reset at half-time. Free throws that are awarded as a result of bonus play or double bonus play often determine the outcome of the game. By custom, the scorekeeper is expected to keep track of the number of fouls, and to alert the referee when the bonus or the double bonus milestone is reached. Often, however, scorekeepers miss these milestones.

Thus, a method and an apparatus that ensure accurate scoring and avoid errors in tournament games are desired.

SUMMARY OF THE INVENTION

The present invention provides methods and systems that ensure accurate scorekeeping of a sporting contest through a graphical user interface on a scoreboard control device. (The scoreboard control device is used to keep score and transmits information to the score board for display.) Thus, a scorekeeper interacts with the graphical user interface to manipulate scores to be displayed on the score board. The graphical user interface displays images of control objects (e.g., a control panel or a keypad) which are each associated with one side of the sporting contest. (Each side of the sporting contest, whether a single player or a team, is referred to as a "participant."). To prevent scoring errors resulting from mis-identifying a participant, the present invention associates and displays each control object associated with the score of a participant with a color distinguishing the participant from the other participants of the sporting contest. Most conveniently, the color used for each participant in the graphical user interface corresponds to the color of the uniforms worn by that participant.

In one embodiment, the control object on the graphical user interface is a control panel for the score board, including a keypad for operating the controls. According to another aspect of the present invention, a graphical user interface presents a visual indicator which allows the scorekeeper to associate a basket with its current owning team (i.e., the owning team for that half of the game). In one implementation, the graphical user interface presents to the user a diagram representing the basketball court as seen from the perspective of the scorekeeper (the scorekeeper is presumed to be located at the center line of the basketball court), and requests the scorekeeper to associate each half of the basketball court with the color of the owning team of the basket inside that half. Each half of the basketball court is then displayed in the color of the associated owning team. Thus, when a basket is made on one half of the basketball court, the scorekeeper is prompted by color to credit the basket to the team whose color is displayed for that half of the basketball court. (In conjunction with displaying the scoreboard control panels in corresponding team colors, this visual association of the halves of the basket ball court with team colors ensures a high degree of accuracy in the scorekeeping.) In addition, when the scorekeeper indicates that the second half of the game has begun, the ownerships of the baskets are automatically exchanged to ensure that the score remains correctly credited to the appropriate participant. (The colors displayed by the graphical user interface for the baskets are also automatically exchanged).

In one embodiment, the input device for the graphical user interface is a touch-sensitive screen, which may be part of the display device, such as a liquid crystal display (LCD).

According to another aspect of the present invention, a mechanism is provided to keep track of events that are significant to scoring or rules of play (e.g., the number of fouls committed by a participant) and to alert the scorekeeper of the occurrence of such event. In the case of basketball, for example, the present invention provides a visual or audio alert when the number of fouls exceeds predetermined thresholds. The alert prevents referees from inadvertently overlooking bonus play or double bonus play conditions.

The present invention is better understood upon consideration of the detailed description below and the accompanying drawings.

DETAILED DESCRIPTION OF THE PREFERRED EMBODIMENTS

The present invention is preferably implemented on a tablet-style portable computer, or a portable or notebook computer that is configured to allow its display (e.g., a liquid crystal display (LCD) to be folded down flat and facing up, so that the display itself does not block the scorekeeper's field of vision. The LCD preferably has a touch-sensitive screen that can be used for input purpose. Alternatively, a conventional portable or desktop computer can also be used, preferably in conjunction with a touch-sensitive screen. The present invention can also be implemented in a color personal digital assistant (PDA), such as those known and marketed under the names PalmPad and iPAQ. While having exceptional portability, PDA devices provide less precise control because of their size.

Figure 1:
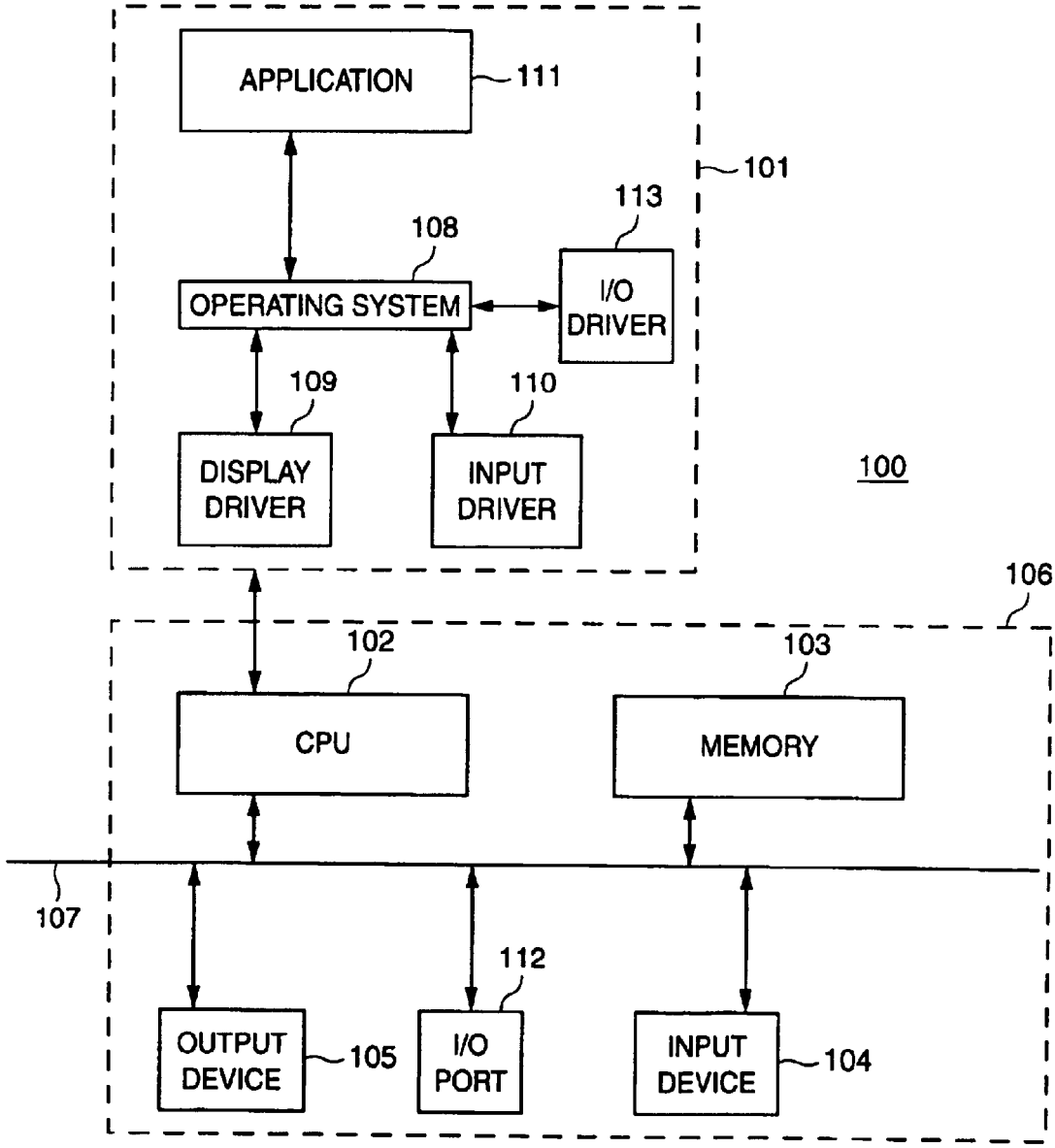
FIG. 1 is a schematic representation of the software and hardware environments 100 in which one embodiment of the present invention can be implemented.

FIG. 1 is a schematic representation of the software and hardware environment 100 in which one embodiment of the present invention can be implemented. As shown in FIG. 1, software environment 101, which is typically created in memory system 103 as various program segments to be executed in central processing unit (CPU) 102, controls the operation of hardware environment 106. Hardware environment 106 is a generalized representation of a hardware platform suitable for implementing the present invention, such as described above. In hardware environment 106, CPU 102 can be implemented by a microprocessor, memory system 103 can be implemented by non-volatile and volatile memory components (e.g., dynamic random access memories and read-only memories), input/output (I/O) port 112 can be implemented by any I/O port controller for a conventional I/O port (e.g., parallel, serial or universal serial broadcast port), input device 104 can be implemented by an adaptor receiving input signals from the touch-sensitive screen discussed above, and output device 105 can be implemented by an adapter driving the LCD discussed above. I/O port 112 provides an interface to control a conventional score board. System bus 107 is provided for communication among CPU 102, memory system 103, I/O port 112, input device 104 and output device 105. Of course, those skilled in the art will recognize that the LCD and the touch-sensitive screen can be implemented in one single device, so that input device 104 and output device 105 can also be implemented in a single device.

Software environment 101 includes operating system 108 (e.g., Windows XP, Windows CE), software device drivers 109, 110 and 113 that control output device 105, input device 104 and I/O port 112, respectively, and application program 111 that implements various aspects of the present invention. Application program 111 communicates with operating system 108, and includes a graphical user interface (GUI) for interacting with a scorekeeper. Application program 111 can be created using a programming language (e.g., Visual Basic) and associated compilation facilities.

Figure 2A:
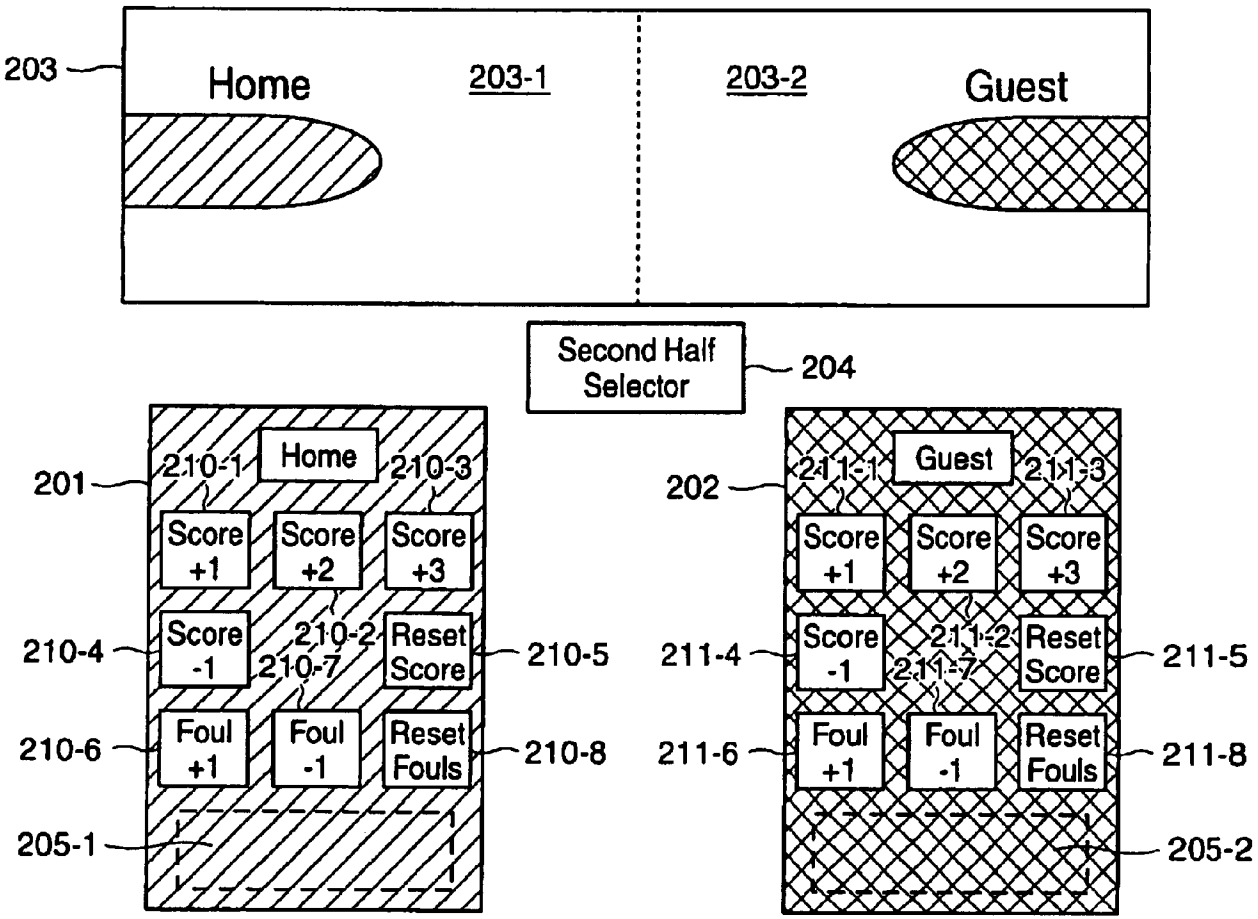
FIGS. 2*a* and 2*b* show images of control screen 200 (displayed under control of the GUI of application program 111) for the first and second halves of a game, respectively, according to one embodiment of the present invention.
Figure 2B:
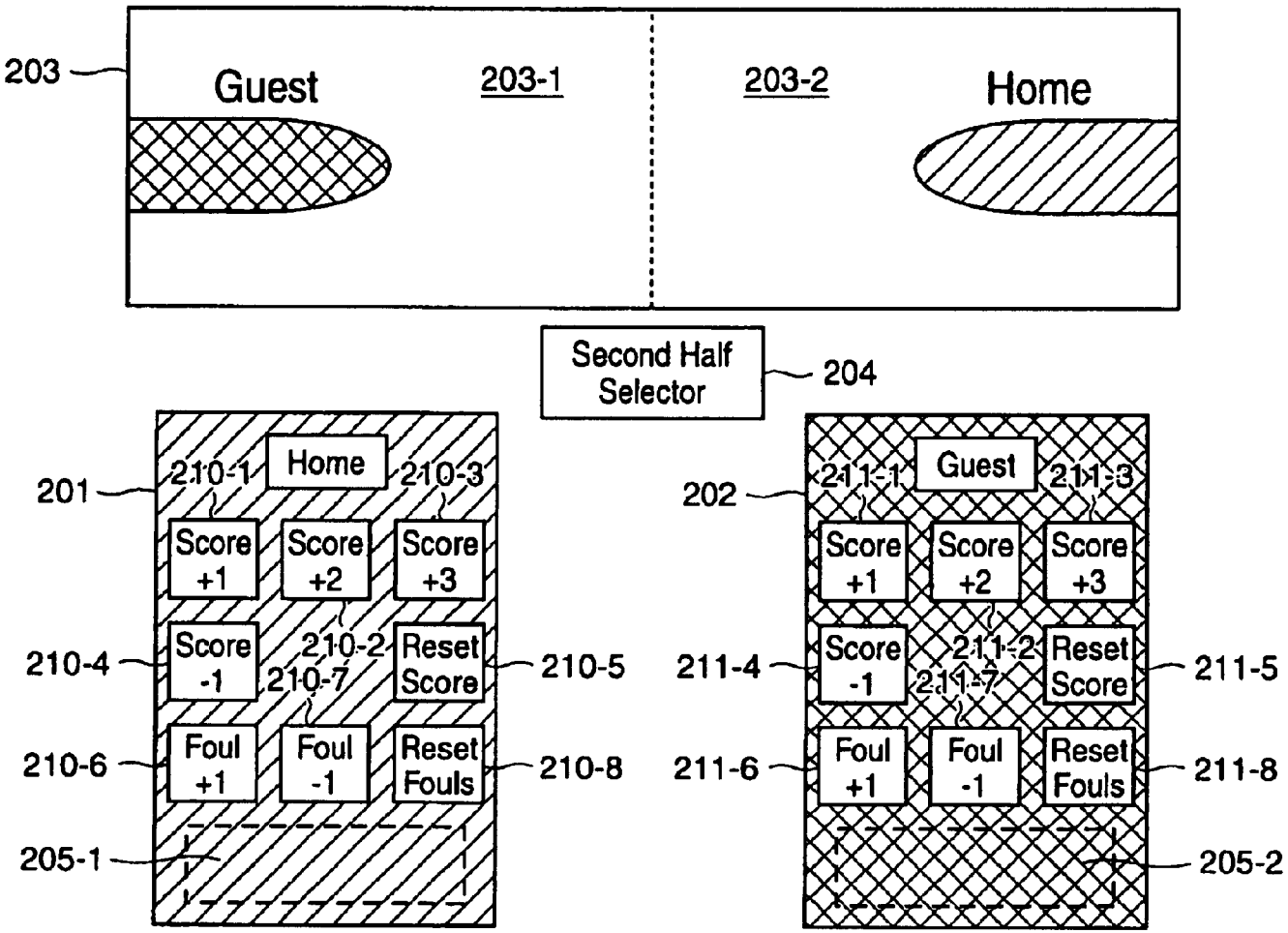

According to one embodiment of the present invention, application program 111 provides control screen 200 (FIGS. 2*a* and 2*b*) that is displayed under control of the GUI. FIGS. 2*a* and 2*b* show images of control screen 200 for the first and second halves of a game, respectively. In each of FIGS. 2*a* and 2*b*, control screen 200 includes blocks 201 and 202 which display, respectively, soft control keys 210-1 to 210-8 and 211-1 to 211-8 for receiving input from the scorekeeper. If application program 111 is created in Visual Basic, control screen 200 can be implemented using a Form object. Within the Form object, blocks 201 and 202 can each be implemented inside a Picture Box container, with the soft control keys implemented as Command Buttons. In that implementation, each soft control key can be labeled by setting the Caption property. Blocks 201 and 202 are respectively labeled "Home" and "Guest," and the backgrounds surrounding the control keys are displayed correspondingly in the colors of the jerseys worn by the teams. For example, the background in block 201 is displayed in red, and the background in block 202 is displayed in blue. At the beginning of the game, as an initialization procedure, the scorekeeper is prompted through the GUI to associate the colors with blocks 201 and 202. In a Visual Basic implementation, two List Boxes can be presented to the scorekeeper through the GUI, each showing a scrollable list of color choices from which the scorekeeper can choose the Home or Guest color. Upon the scorekeeper making the selection, the Fillcolor method can be called from the GUI to provide the color of the background. Keys 210-1 to 210-12 and 211-1 to 211-12 can be selected and activated through the touch-sensitive screen, or alternatively, if a touch-sensitive screen is not used, through a pointing device (e.g., buttons associated with a mouse or a track ball). Because the scorekeeper can now be guided by the colors of the teams' jerseys, rather than the traditional Home and Guest designations, as she operates the controls, scorekeeper errors relating to incorrect identification of the Home and Guest teams are expected to be substantially eliminated.

According to another aspect of the present invention, control block 203 (FIG. 2*a*) can be created and displayed to the scorekeeper to facilitate scoring. As shown in FIG. 2*a*, control screen 203 includes a graphical representation of the basketball court, divided into court areas 203-1 and 203-2, representing the locations of the baskets. If application program 111 is implemented using Visual Basic, court areas 203-1 and 203-2 can be represented by Picture Boxes, and drawn using Circle, Line and any other suitable drawing methods.

As part of the initialization procedure described above, the scorekeeper is asked to associate the court areas 203-1 and 203-2 with ownership by the Home and Guest teams, as they are positioned from the scorekeeper's perspective. (The scorekeeper is presumed to be seated at or near the center line of the basketball court.) The association can be accomplished, for example, by the scorekeeper selecting from a List Box displaying on one of the court areas either the Home and Guest designations, or the colors of the teams. Upon selection for one court area for one team, ownership of the other court area by the other team is automatically set. As shown in FIG. 2*a*, the basket area in court area 203-2 is provided the color of the Guest team, to indicate ownership by the Guest team. Similarly, the basket area in court area 203-1 is provided the color of the Home team, to indicate ownership by the Home team. As in the case of blocks 201 and 202 above, the Fillcolor method can be called from the GUI to color the basket areas. As the game is played, the scorekeeper can directly correlate a made basket at one end of the court with the owning team using the visual aid provided by block 203-1 or 203-2, and accordingly operate the controls in block 201 or 201, thus correctly crediting the made basket to the corresponding team.

In this embodiment, a "Second Half" selection control 204 indicates that the second half of the game has begun. In a Visual Basic implementation, this selection control can be implemented as a Check Box object to be selected by the scorekeeper at the appropriate time. Upon such selection, the colors of the basket areas in court areas 203-1 and 203-2 are exchanged, indicating an exchange of basket ownerships between the Home and Guest teams. FIG. 2*b* shows that the basket ownerships in the second half are exchanged from the ownerships in the first half. Because the scoring is now guided by the physical locations of the baskets from the perspective of the scorekeeper, rather than being guided by Home and Guest designations, errors crediting scores to the wrong team are expected to be substantially eliminated.

Figure 3:
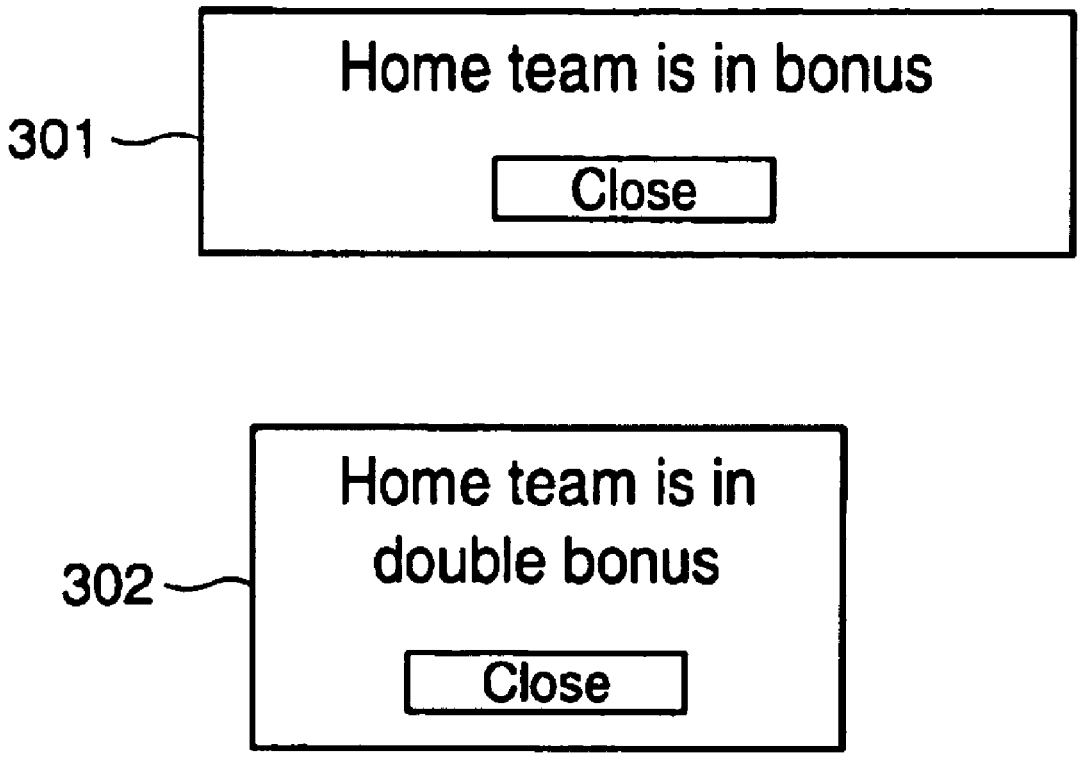
FIG. 3 shows two examples of Pop-Up boxes that can be displayed through the GUI for alerting bonus play and double bonus play conditions, respectively.

According to another aspect of the present invention, a control mechanism is provided for each team (e.g., one of the soft control keys in blocks 201 or 202) to register fouls and to provide appropriate alerts. The number of fouls is automatically incremented each time the control mechanism is selected, and is automatically reset when "Second Half" selection control 204 is selected. In each half, when the foul limit for "bonus" or "double bonus" play is reached, a visual indication is provided to alert the scorekeeper of the corresponding bonus play condition. The visual indication is provided, for example, at the pop-up box areas 205-1 and 205-2 within blocks 201 and 202, respectively. (An audio indication can also be provided, but is expected to be less effective in a noisy gymnasium environment). FIG. 3 shows examples 301 and 302 of Pop-Up boxes that can be displayed through the GUI to alert bonus play and double bonus play conditions, respectively.

The above detailed description is provided to illustrate specific embodiments of the present invention and is not intended to be limiting. Numerous variations and modifications within the scope of the present invention are possible. The present invention is set forth in the following claims.

We claim:

1. An apparatus for controlling a score board, comprising:

an interface to a score board that displays the scores of a plurality of participants in a sporting contest;

an interface to a display device;

an interface to an input device;

a central processing unit coupled to the interface to the scoreboard, the display device and the input device, wherein the central processing unit runs an application program including a graphical user interface, and wherein the graphical user interface displays a plurality of images wherein one of the images includes a graphical representation of the field of the sporting contest and wherein another one of the images is a configurable control object selectable using the input device, associated with maintaining a score of a corresponding one of the participants, each control object being displayed with a color corresponding to the color of the jersey of the participants.

2. The apparatus of claim 1, wherein the control object comprises a control panel of the score board including a plurality of keys for controlling the score board.

3. The apparatus of claim 2, wherein the color is displayed as a background to the plurality of keys.

4. The apparatus of claim 2, wherein the interface to the input device receives input signals indicating selections of the keys.

5. The apparatus of claim 1, wherein the input device comprises a touch-sensitive screen.

6. The apparatus of claim 5, wherein the touch-sensitive screen is a portion of the display device, which comprises a liquid crystal display.

7. The apparatus of claim 1, wherein the participant comprises a basketball team.

8. The apparatus of claim 1, wherein the graphical representation of the field is opposing halves of a basketball court, each half including a graphical representation of a basket.

9. The apparatus of claim 8, wherein the basket in each half is displayed with the color corresponding to the participant that owns the basket.

10. The apparatus of claim 8, wherein the control object comprises a mechanism for keeping a score at the basket.

11. The apparatus of claim 8, wherein the graphical user interface further provides a selection object for a scorekeeper to register an exchange of ownership of the basket.

12. The apparatus of claim 1, wherein the control object provides a mechanism for maintaining a running sum of a number of occurrences of a predetermined event, and wherein when the running sum exceeds a predetermined threshold, the application program provides an alert message.

13. The apparatus as in claim 12, wherein the alert message comprises a graphical object provided through the graphical user interface.

14. The apparatus as in claim 12, wherein the alert message comprises an audio signal.

15. The apparatus of claim 12, wherein the predetermined event represents a foul condition.

16. A method for accurately scoring of a sporting contest through a graphical user interface for display on a score board, comprising:

creating for display on a display device a plurality of images configurable of control objects relating to maintaining scores to be displayed on the score board, each control object being associated with one of the participants of the sporting contest wherein one of the images includes a graphical representation of the field of the sporting contest;

associating each control object with the color of the jersey worn by a participant;

displaying the images on the display device with the associated colors;

enabling sending of commands associated with the control objects using an input device; and receiving the commands from the input device.

17. The method of claim 16, wherein each control object comprises a control panel of the score board including a plurality of keys for controlling the score board.

18. The method of claim 17, wherein the color of each control object is displayed as a background to the plurality of keys.

19. The method of claim 17, wherein the scorekeeper uses the input device to indicate selections of the keys.

20. The method of claim 16, wherein the input device comprises a touch-sensitive screen.

21. The method of claim 20, wherein the touch-sensitive screen is a portion of the display device, which comprises a liquid crystal display.

22. The method of claim 16, wherein the participant comprises a basketball team.

23. The method of claim 16, wherein the graphical representation of the field is opposing halves of a basketball court, each half including a graphical representation of a basket.

24. The method of claim 23, wherein the basket in each half is displayed with the color corresponding to the participant that owns the basket.

25. The method of claim 24, wherein the control object comprises a mechanism for keeping a score at the basket.

26. The method of claim 24, wherein the graphical user interface further provides a selection object for a scorekeeper to register an exchange of ownership of the basket.

27. The method of claim 16, further comprising:

providing a mechanism for maintaining a running sum of a number of occurrences of a predetermined event; and providing an alert message when the running sum exceeds a predetermined threshold.

28. The method as in claim 27, wherein the alert message is shown on the display device.

29. The method as in claim 27, wherein the alert message is provided as an audio signal.

30. The method of claim 27, wherein the predetermined event represents a foul condition.

* * * * *